US011595757B2

(12) United States Patent
Suyama

(10) Patent No.: US 11,595,757 B2
(45) Date of Patent: Feb. 28, 2023

(54) AUDIO SIGNAL INPUT AND OUTPUT DEVICE, AUDIO SYSTEM, AND AUDIO SIGNAL INPUT AND OUTPUT METHOD

(71) Applicant: Yamaha Corporation, Hamamatsu (JP)

(72) Inventor: Akio Suyama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/000,483

(22) Filed: Aug. 24, 2020

(65) Prior Publication Data

US 2020/0396541 A1 Dec. 17, 2020

Related U.S. Application Data

(63) Continuation of application No. PCT/JP2019/005807, filed on Feb. 18, 2019.

(30) Foreign Application Priority Data

Feb. 26, 2018 (JP) ..... JP2018-031425

(51) Int. Cl.
*H04R 3/12* (2006.01)

(52) U.S. Cl.
CPC ..... *H04R 3/12* (2013.01)

(58) Field of Classification Search
CPC ..... H04R 3/12; H04R 3/00
USPC ..... 381/55, 59, 77, 81–82, 85, 119, 123
See application file for complete search history.

(56) References Cited

U.S. PATENT DOCUMENTS 9,031,262 B2 * 5/2015 Silfvast ..... G10H 1/18 381/98
9,681,232 B2 * 6/2017 Millington ..... H04R 3/12
10,587,968 B2 * 3/2020 Maeda ..... H04R 29/002
10,848,871 B2 * 11/2020 Baek ..... H04N 21/43615
2008/0075295 A1 * 3/2008 Mayman ..... H04R 3/12 381/79
2014/0301574 A1 * 10/2014 Gottlieb ..... G10H 1/365 381/119
2015/0256926 A1 * 9/2015 Kim ..... H04R 3/12 381/77
2016/0381475 A1 * 12/2016 Starobin ..... G10K 11/17817 381/81

(Continued)

FOREIGN PATENT DOCUMENTS

JP 2005-175745 A 6/2005
WO WO 2017/029946 A1 2/2017

OTHER PUBLICATIONS

International Search Report (PCT/ISA/210) issued in PCT Application No. PCT/JP2019/005807 dated May 14, 2019 with English translation (two (2) pages).

(Continued)

*Primary Examiner* — Disler Paul
(74) *Attorney, Agent, or Firm* — Crowell & Moring LLP

(57) ABSTRACT

An audio signal input and output device includes a port that inputs or outputs an audio signal, an interface that receives a specification of a channel or bus to be assigned to the port, and a sender that sends information over a network for assigning the channel or bus based on the specification received by the interface. The information assigns the inputted audio signal to a predetermined input channel of the management device. A speaker emits a sound based on the inputted audio signal.

12 Claims, 14 Drawing Sheets

(56) References Cited

U.S. PATENT DOCUMENTS

2018/0084361 A1 3/2018 Tanaka et al.

OTHER PUBLICATIONS

Japanese-language Written Opinion (PCT/ISA/237) issued in PCT Application No. PCT/JP2019/005807 dated May 14, 2019 (four (4) pages).
Japanese-language Notice of Reasons for Refusal issued in Japanese Application No. 2020-501747 dated Jul. 6, 2021 with English translation (6 pages).

* cited by examiner

AUDIO SIGNAL INPUT AND OUTPUT DEVICE, AUDIO SYSTEM, AND AUDIO SIGNAL INPUT AND OUTPUT METHOD

CROSS REFERENCE TO RELATED APPLICATIONS

The present application is a continuation application of International Patent Application No. PCT/JP2019/005807, filed on Feb. 18, 2019, which claims priority to Japanese Patent Application No. 2018-031425, filed on Feb. 26, 2018. The contents of these applications are incorporated herein by reference in their entirety.

BACKGROUND AND SUMMARY OF THE INVENTION

Japanese Unexamined Patent Application Publication No. 2005-175745 discloses an audio system including a plurality of speakers and a server. The plurality of speakers and the server are connected to each other through a network. The server gives an identifier to each of the plurality of speakers. As a result, a user can identify the plurality of speakers in an audio system.

However, even when an identifier is given to each of a plurality of devices, in a case in which the number of devices is increased, it is difficult for a user to set which audio signal is sent to which device or which audio signal is received from which device.

In view of the foregoing, an example embodiment of the present subject matter is directed to provide an audio signal input and output device, an audio system, and an audio signal input and output method that make it easy for a user to set which audio signal is sent to which device or which audio signal is received from which device.

An audio signal input and output device includes a port that inputs or outputs an audio signal, an interface that receives specification of a channel or bus to be assigned to the port, and a sender that, based on the received specification, sends information for assigning the channel or bus, to a management device.

A user can easily set which audio signal is sent to which device or which audio signal is received from which device.

The above and other elements, features, steps, characteristics and advantages of the present subject matter will become more apparent from the following detailed description of the example embodiments with reference to the attached drawings.

DETAILED DESCRIPTION OF THE DRAWINGS

Figure 1:
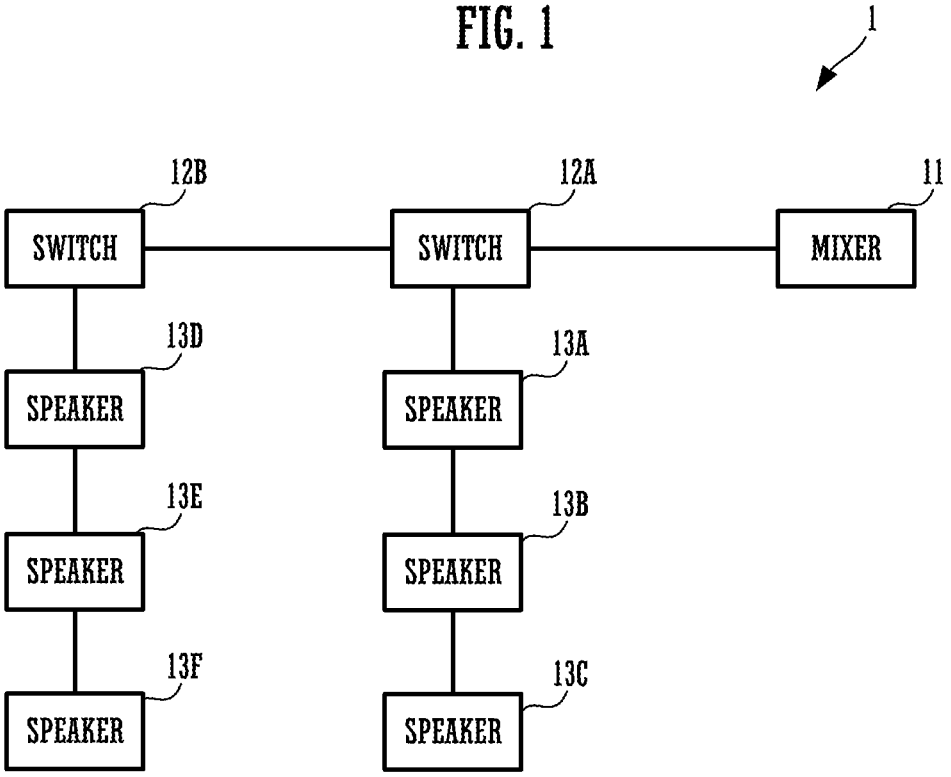
FIG. 1 is a block diagram showing a configuration of an audio system 1.

FIG. 1 is a block diagram showing a configuration of an audio system 1. The audio system 1 includes devices such as a mixer 11, a plurality of switches (a switch 12A and a switch 12B), and a plurality of speakers (a speaker 13A to a speaker 13F).

The devices are connected to each other through network using a network cable. For example, the mixer 11 is connected to the switch 12A and switch 12B through the network. The switch 12A is connected to the switch 12B and the speaker 13A through the network. The speaker 13A, the speaker 13B, and the speaker 13C are connected in a daisy chain. In addition, the speaker 13D, the speaker 13E, and the speaker 13F are also connected in a daisy chain. However, in the present subject matter, the connection between the devices is not limited to the example embodiment shown in FIG. 1. In addition, each device does not need to be connected by a network, and may be connected by a communication line such as a USB cable, an HDMI (registered trademark), or a MIDI, for example, or may be connected with a digital audio cable.

The mixer 11 is an example of a management device of the present subject matter. The mixer 11 receives an input of an audio signal from other devices connected by the network. The mixer 11 outputs an audio signal to other devices. The speaker 13A to the speaker 13F are examples of an audio signal input and output device of the present subject matter. It is to be noted that the management device is not limited to the mixer 11. For example, an information processor such as a personal computer is also an example of the management device. In addition, a system (DAW: Digital Audio Workstation) including hardware or software for performing work such as audio recording, editing, or mixing is also an example of the management device.

Figure 2:
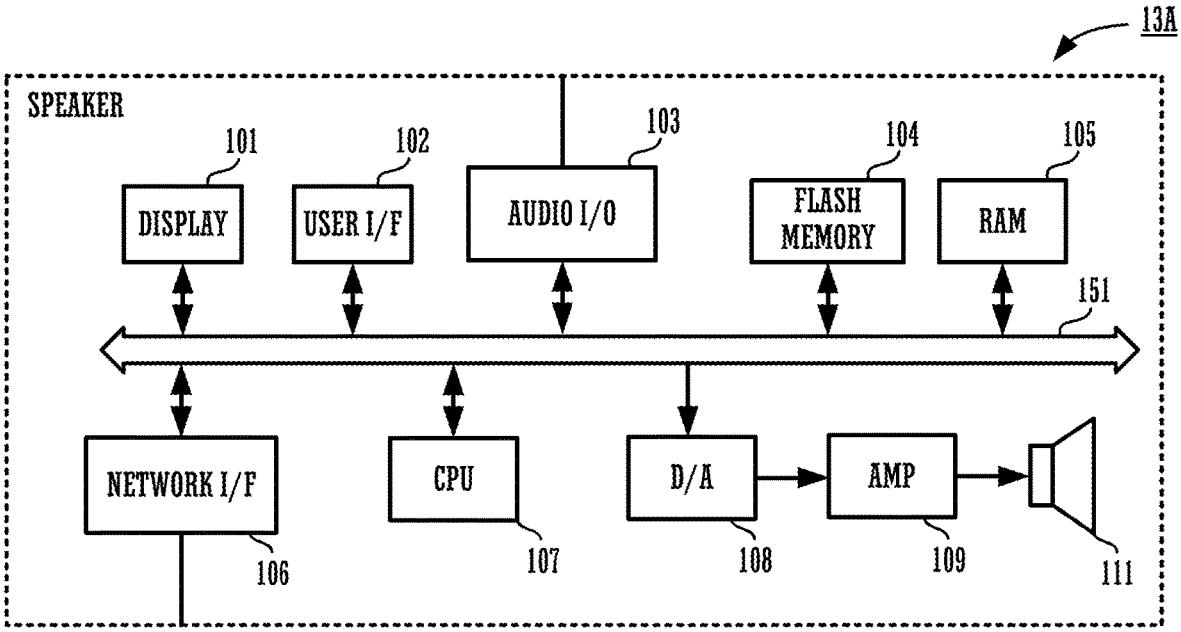
FIG. 2 is a block diagram showing a configuration of a speaker.

FIG. 2 is a block diagram showing a configuration of the speaker 13A. It is to be noted that, since the speaker 13A to the speaker 13F all have the same configuration, FIG. 2 shows the configuration of the speaker 13A as a representative.

The speaker 13A includes a display 101, a user interface (I/F) 102, an audio I/O (Input/Output) 103, a flash memory 104, a RAM 105, a network interface (I/F) 106, a CPU 107, a D/A converter 108, an amplifier 109, and a speaker unit 111. The display 101, the user interface (I/F) 102, the audio I/O (Input/Output) 103, the flash memory 104, the RAM 105, the network interface (I/F) 106, the CPU 107, and the D/A converter 108 are connected to a bus 151. The amplifier 109 is connected to the D/A converter 108 and the speaker unit 111.

The display 101 includes an LCD (Liquid Crystal Display) or an OLED (Organic Light-Emitting Diode), for example, and displays various types of information. The user I/F 102 includes a switch, a knob, or a touch panel, and receives an operation from a user. In a case in which the user I/F 102 is a touch panel, the user I/F 102 constitutes a GUI (Graphical User Interface, the rest is omitted) together with the display 101.

The CPU 107 reads the program stored in the flash memory 104 being a storage medium to the RAM 105 and implements a predetermined function. For example, the CPU 107 displays an image for receiving an operation from the user on the display 101, and, by receiving an operation such as a selection operation to the image through the user I/F 102, implements the GUI. In addition, the CPU 107, based on content received by the user I/F 102, sends information for assigning the speaker 13A to a specific channel or bus of the mixer 11. In other words, the CPU 107 functions as a sender together with the network I/F 106. In addition, the CPU 107 also functions as a receiver together with the network I/F 106.

It is to be noted that the program that the CPU 107 reads does not need to be stored in the flash memory 104 in the own device. For example, the program may be stored in a storage medium of an external device such as a server. In such a case, the CPU 107 may read the program each time from the server to the RAM 105 and may execute the program.

Figure 3A:
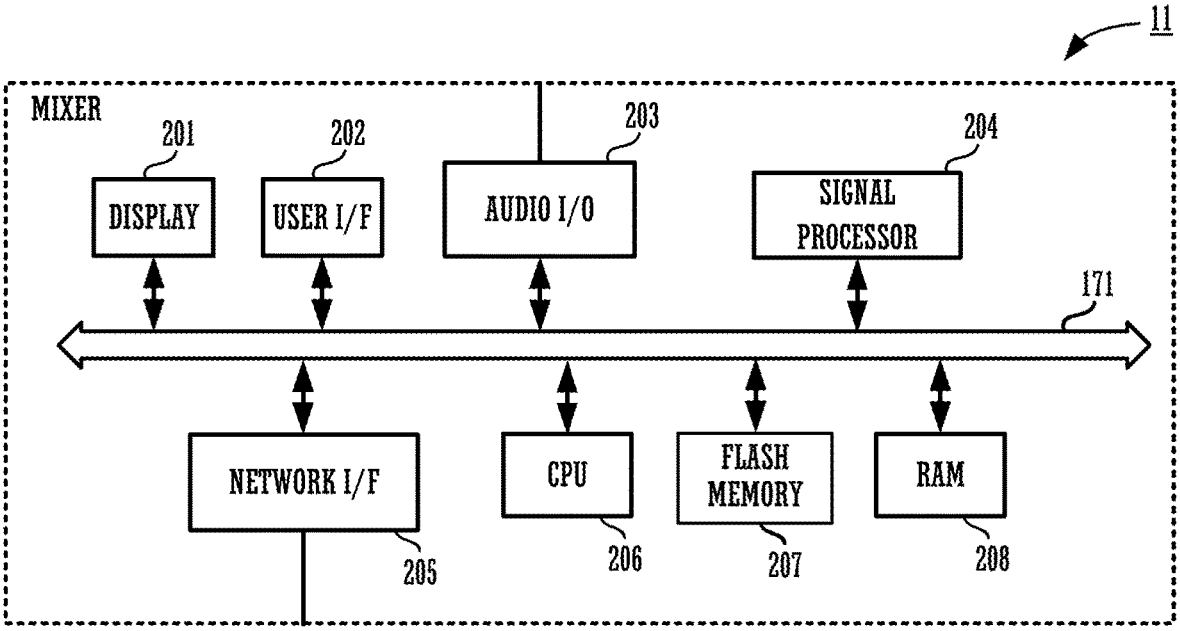
FIG. 3A is a block diagram showing a configuration of a mixer.

FIG. 3A is a block diagram showing a configuration of the mixer 11. The mixer 11 includes components such as a display 201, a user I/F 202, an audio I/O (Input/Output) 203, a signal processor (DSP) 204, a network I/F 205, a CPU 206, a flash memory 207, and a RAM 208. The components are connected to each other through a bus 171.

The CPU 206 is a controller that controls the operation of the mixer 11. The CPU 206 reads and implements a predetermined program stored in the flash memory 207 being a storage medium to the RAM 208 and performs various types of operations. For example, the CPU 206 assigns a specific bus to the speaker 13A, based on the information received from the speaker 13A through the network I/F 205.

It is to be noted that the program that the CPU 206 reads does not also need to be stored in the flash memory 207 in the own device. For example, the program may be stored in a storage medium of an external device such as a server. In such a case, the CPU 206 may read the program each time from the server to the RAM 208 and may execute the program.

The signal processor 204 includes a DSP for performing various types of signal processing. The signal processor 204 performs signal processing such as mixing, equalizing, or compressing, on an audio signal to be inputted through the audio I/O 203 or the network I/F 205. The signal processor 204 outputs the audio signal on which the signal processing has been performed, to another device such as the speaker 13A, through the audio I/O 203 or the network I/F 205.

Figure 3B:
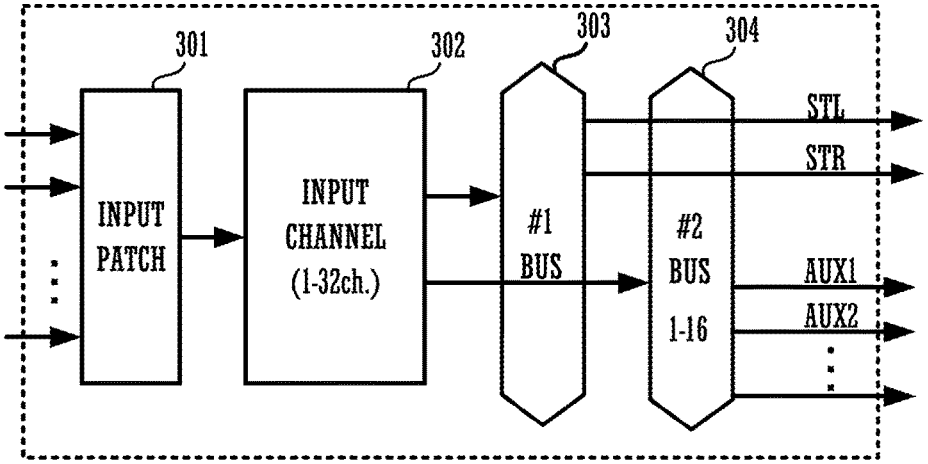
FIG. 3B is an equivalent block diagram of signal processing to be performed by a signal processor, an audio I/O, and a CPU.

FIG. 3B is a functional block diagram of signal processing to be achieved by the signal processor 204 and the CPU 206. As shown in FIG. 3B, the signal processing is functionally performed by an input patch 301, an input channel 302, a first bus (#1 bus) 303, and a second bus (#2 bus) 304.

The input channel 302 has a signal processing function of 32 channels as an example. An audio signal is inputted from the input patch 301 to each channel of the input channel 302. The each channel of the input channel 302 performs various types of signal processing on the inputted audio signal. In addition, the each channel of the input channel 302 sends out the audio signal on which the signal processing has been performed, to buses (the #1 bus 303 and the #2 bus 304) provided in a subsequent stage.

Each of the #1 bus 303 and the #2 bus 304 mixes and outputs the audio signal to be inputted. The #1 bus 303 has an STL (a stereo L) bus and an STR (a stereo R) bus as an example. The #2 bus 304 has 16 buses from an AUX1 to an AUX16 as an example.

The audio signal to be outputted from each bus is subjected to signal processing in a not-shown output channel. Subsequently, the subjected audio signal is outputted to the audio I/O 203 or the network I/F 205. The mixer 11 outputs an audio signal to a device assigned to each bus.

For example, an IP address is assigned to each device. The CPU 107 sends data according to an audio signal to the IP address assigned to each bus. In the example of FIG. 1, the mixer 11 outputs the audio signal of the bus assigned to each of the speaker 13A to the speaker 13F that are connected by the network.

Then, in the audio system 1 according to the present example embodiment of the present subject matter, a user can instruct to assign a bus by operating the speaker 13A to the speaker 13F.

Figure 4:
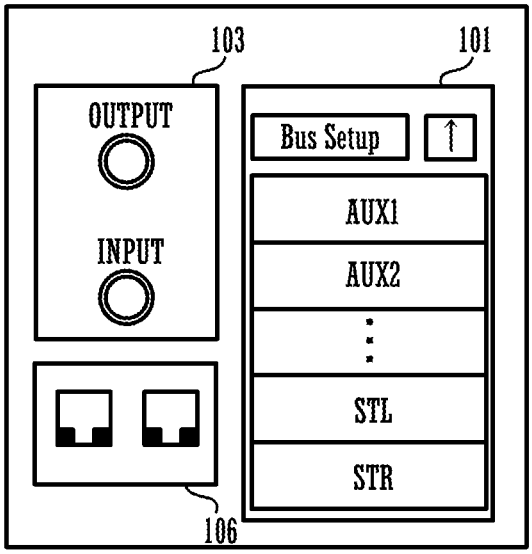
FIG. 4 is a view showing an example of an external appearance of a display 101, an audio I/O 103, and a network I/F 106 of a speaker 13A.

FIG. 4 is a view showing an example of the external appearance of the display 101, the audio I/O 103, and the network I/F 106 of the speaker 13A. The display 101, the audio I/O 103, and the network I/F 106 are provided in a portion of a housing of the speaker 13A. It is to be noted that, in this example, a touch panel is stacked on the display 101 as the user I/F 102, which configures the GUI.

The display 101 displays a bus setup screen. The AUX1, the AUX2 . . . the AUXn, the STL, and the STR that are the buses of the mixer 11 are displayed on the bus setup screen. A user selects any bus to be assigned to the speaker 13A from the displayed buses.

Figure 5:
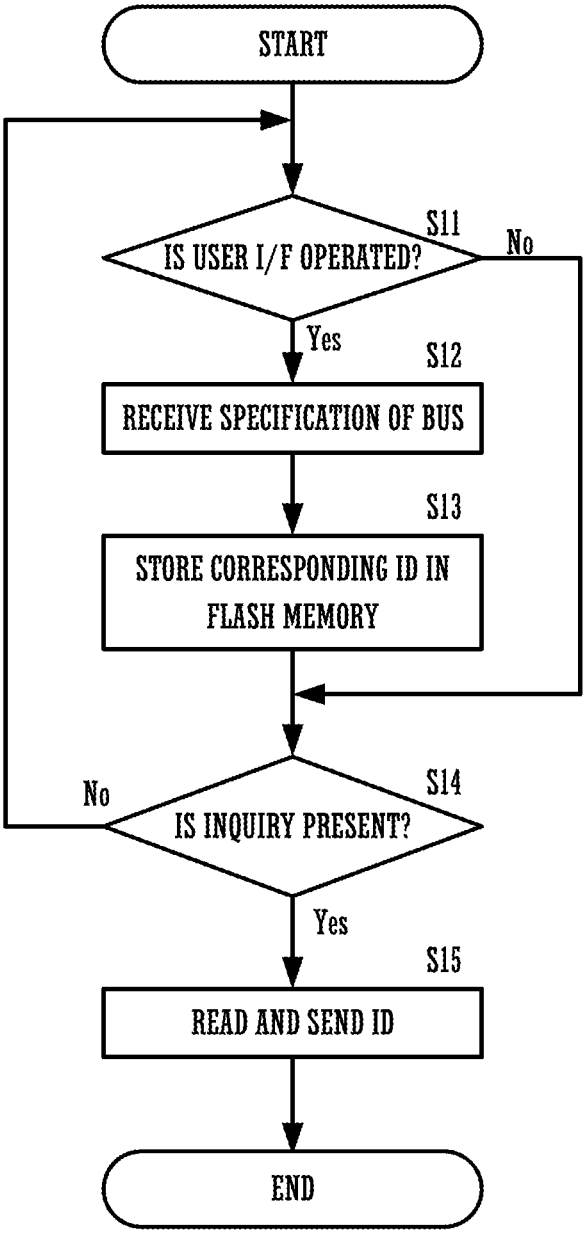
FIG. 5 is a flow chart showing an operation of the speaker 13A.

FIG. 5 is a flow chart showing an operation of the speaker 13A. The CPU 107 first determines whether an operation has been performed with respect to the user I/F 102 (S11). In a case in which the user I/F 102 is operated (Yes in S11), the user I/F 102 receives the specification of a bus to be assigned to the own device (S12).

When the CPU 107 obtains the specification of a bus through the user I/F 102, the CPU 017 stores an ID corresponding to the bus, in the flash memory 104 or the RAM 105 (S13). A unique ID is assigned to each bus. For example, about several bits of unique information is assigned to each bus, such as ID: 0001 to the AUX1, ID: 0002 to the AUX2, and the like.

Subsequently, the CPU 107 determines whether or not an inquiry of ID has been received from the mixer 11, for example, as another device on a network (S14). It is to be noted that, in determination of S11, in a case in which the user I/F 102 is not operated (No in S11), the CPU 107 skips processing of S12 and S13, and proceeds to the determination of S14.

When the CPU 107 receives no inquiry from other devices (No in S14), the CPU 107 returns to the determination of S11. The CPU 107, when receiving an inquiry from other devices (Yes in S14), reads an ID from the flash memory 104 or the RAM 105, and sends the ID to the mixer 11 being a management device (S15). As a result, the ID is notified to the mixer 11. It is to be noted that, in a case in which the ID is stored in the flash memory 104, the speaker 13A, even when rebooting after the power supply is shut off, is able to send the same ID to the mixer 11. Therefore, even when a user moves the speaker 13A to different halls and the network connection configuration is changed, the assignment of a bus is able to be reproduced since the same ID is sent to the management device.

Figure 6:
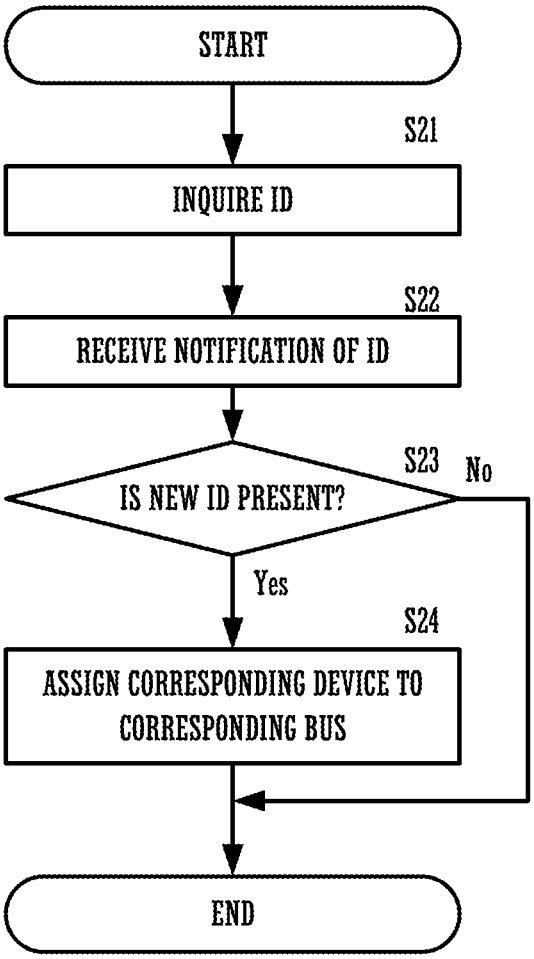
FIG. 6 is a flow chart showing an operation of the mixer 11.

FIG. 6 is a flow chart showing an operation of the mixer 11. The CPU 206 of the mixer 11 periodically performs the operation of the flow chart shown in FIG. 6. The mixer 11 inquires of devices in the network about an ID (S21). The inquiry may be sent by broadcasting to all the devices in the network. In addition, the CPU 206 associates each device IP address of the network with a corresponding ID. The CPU 206 stores each device IP address of the network the corresponded ID, in the flash memory 207 or the RAM 208. In a case in which an IP address of a specific device without a corresponding ID is detected, an inquiry may be individually sent to the specific device.

The mixer 11 receives notification of an ID from each device in response to the inquiry (S22). The mixer 11 determines whether or not a new ID is included in the notification received from each device (S23). The mixer 11, in a case of having found a new ID that is not stored in the flash memory 207 or the RAM 208 (Yes in S23), associates a bus corresponding to the new ID with the IP address of a device that has sent the ID. The mixer 11 stores the bus corresponding to the new ID and the corresponded IP address in the flash memory 207 or the RAM 208, and assigns a corresponding device (S24). The mixer 11, in a case of having not found a new ID (No in S23), ends the operation.

As described above, in the audio system 1 according to the present example embodiment of the present subject matter, the speaker 13A to the speaker 13F are able to instruct the assignment of a bus. As a result, a user can specify a sound which is requested by the user from each installed speaker. Therefore, even when the number of installed speakers is increased, the user can easily set which speaker is caused to send an audio signal of which bus. In other words, the user, only by operating (such as, switching on) a speaker, can cause a sound of a desired bus to be outputted from the speaker. For example, in a case in which one speaker is damaged or the like and needs to be replaced with a different speaker, the user, simply by specifying a bus by the replaced different speaker without having to change the settings of the mixer 11, can cause the different speaker to receive an audio signal from a predetermined bus.

Figure 7:
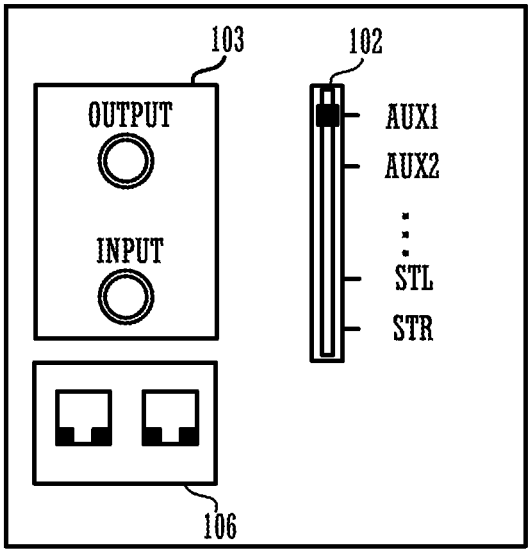
FIG. 7 is a view showing an example of a user I/F 102 according to a first modification.

Next, FIG. 7 is a view showing an example of the user I/F 102 according to a first modification. In the first modification of FIG. 7, the speaker 13A includes a user I/F 102, an audio I/O 103, and a network I/F 106 in a portion of a housing. In the first modification, the speaker 13A does not include the display 101. As a matter of course, also in the first modification, the speaker 13A may include a display for displaying a signal level or the like.

The speaker 13A of the first modification includes a DIP switch as an example of the user I/F 102. Each switching point of the DIP switch displays an AUX1, an AUX2, . . . an AUXn, an STL, and an STR that are a plurality of buses in the mixer 11. A user can switch the DIP switch and select any bus to be assigned to the speaker 13A from the displayed buses. In this manner, specification of a bus is not limited to an example embodiment in which a GUI is used.

Figure 8:
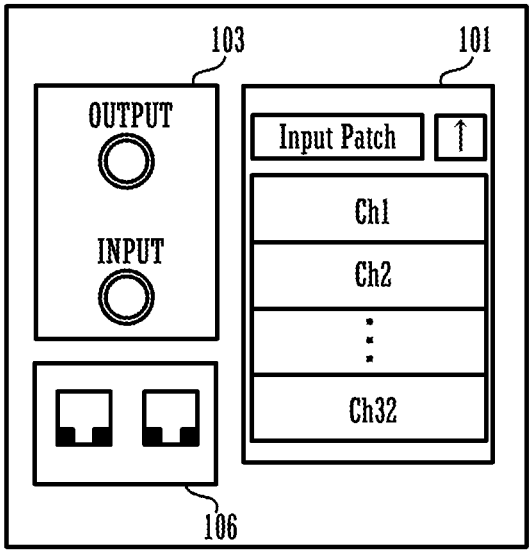
FIG. 8 is a view showing an example of an external appearance of a display 101, an audio I/O 103, and a network I/F 106 of a speaker 13A according to a second modification.

Next, FIG. 8 is a view showing an example of the external appearance of a display 101, an audio I/O 103, and a network I/F 106 of a speaker 13A according to a second modification. In this example, a touch panel is stacked on the display 101 as the user I/F 102, which configures the GUI.

The speaker 13A according to the second modification receives an input of an audio signal from the audio I/O 103. The speaker 13A outputs the audio signal inputted from the audio I/O 103 to the D/A converter 108. The amplifier 109 amplifies an analog audio signal that the D/A converter 108 outputs. The speaker unit 111 outputs a sound, based on the analog audio signal that the amplifier 109 has amplified. As a result, the speaker 13A outputs a sound according to the audio signal inputted to the audio I/O 103, from the speaker unit 111.

Then, the speaker 13A sends the audio signal inputted from the audio I/O 103, to a different device such as the mixer 11 through the network I/F 106. The mixer 11 receives the audio signal from the speaker 13A, and inputs the audio signal to a predetermined input channel assigned to the speaker 13A.

The speaker 13A according to the second modification, as shown in FIG. 8, displays a list of input channels in the mixer 11 on the display 101. A user selects any input channel to be assigned to the speaker 13A from the displayed input channels. The CPU 107 of the speaker 13A, when receiving specification of an input channel, stores an ID corresponding to the input channel, in the flash memory 104 or the RAM 105. In such a case as well, a unique ID is assigned to each input channel. For example, about several bits of unique information is assigned to the each input channel, such as ID: 0101 to an input channel 1 (Ch 1), ID: 0102 to an input channel 2 (Ch 2), and the like.

Then, the CPU 107, in a case of receiving an inquiry of an ID from the mixer 11 being a management device, reads an ID from the flash memory 104 or the RAM 105, and sends the ID to the mixer 11. As a result, the ID is notified to the mixer 11. The mixer 11, in a case of having found a new ID that is not stored in the flash memory 207 or the RAM 208, stores an input channel corresponding to the new ID and the IP address of a device that has sent the ID in association with each other, in the flash memory 207 or the RAM 208. The mixer 11 assigns the device that has sent the ID to a predetermined input channel.

Accordingly, in the audio system 1 according to the second modification, a user can instruct assignment of an input channel in the mixer 11, using the speaker 13A to the speaker 13F. In other words, the speaker 13A to the speaker 13F simply have a function of the input patch 301 of the mixer 11. As a result, the speaker 13A to the speaker 13F, while being able to be used as a monitor speaker for checking the sound of a musical instrument or the like that is connected to the audio I/O 103, is also able to be used as an I/O device to send an audio signal according to the sound of the musical instrument or the like, to the mixer 11. For example, when a microphone is connected to the audio I/O 103 of the speaker 13A, an audio signal of the microphone is able to be sent to the mixer 11 through a network. In this manner, the user can use the speaker 13A as an I/O device including a network I/F.

Figure 9:
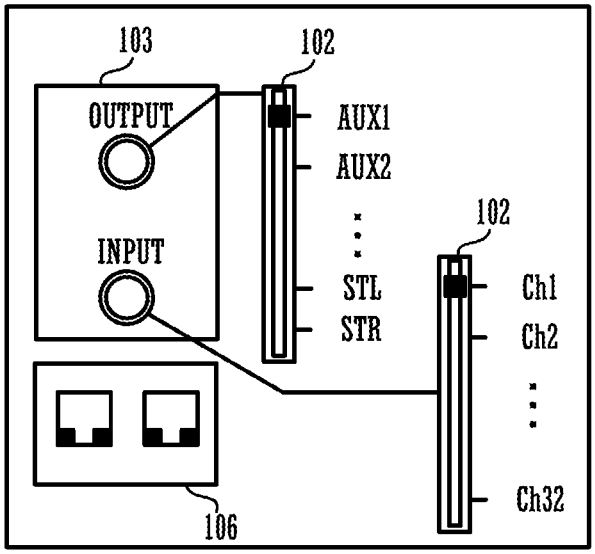
FIG. 9 is a view showing an example of a user I/F 102 according to a third modification.

It is to be noted that, even when such assignment on the side of an input channel is performed, as shown in a third modification of FIG. 9, the user I/F 102 may be configured using other hardware interfaces such as DIP switches. The speaker 13A of the third modification of FIG. 9 includes a DIP switch for an input port, and a DIP switch for an output port as an example of the user I/F 102. Each switching point of the DIP switch for an output port displays an AUX1, an AUX2 . . . an AUXn, an STL, and an STR that are a plurality of buses in the mixer 11. Each switching point of the DIP switch for an input port displays Ch1 to Ch32 that are a plurality of input channels in the mixer 11. A user can switch the DIP switch and select any input channel to be assigned to the speaker 13A from the displayed input channels. In this manner, specification of an input channel is not limited to an example embodiment in which a GUI is used.

It is to be noted that the present example embodiment provides an example in which the speaker 13A itself being the own device is assigned to the mixer 11 as one input port or one output port. However, the speaker 13A may include a plurality of ports and may assign each port to a different bus or a different input channel. For example, in a case in which the speaker 13A has an input port 1 and an input port 2, the input port 1 and the input port 2 may be respectively assigned to different input Ch1 and input Ch2.

In addition, the speaker 13A may include a DSP for performing signal processing. In such a case, the DSP performs signal processing on an audio signal received through the network I/F 106. The DSP outputs the audio signal on which the signal processing has been performed, to the D/A converter 108. In addition, in a case in which an audio signal is inputted from the audio I/O 103 as with the second modification, the DSP performs signal processing on the audio signal inputted from the audio I/O 103. The DPS outputs the audio signal on which the signal processing has been performed, to the D/A converter 108.

The descriptions of the example embodiments of the present subject matter are illustrative in all points and should not be construed to limit the present subject matter. The scope of the present subject matter is defined not by the foregoing example embodiments but by the following claims for patent. Further, the scope of the present subject matter is intended to include all modifications within the scopes of the claims for patent and within the meanings and scopes of equivalents.

Figure 10:
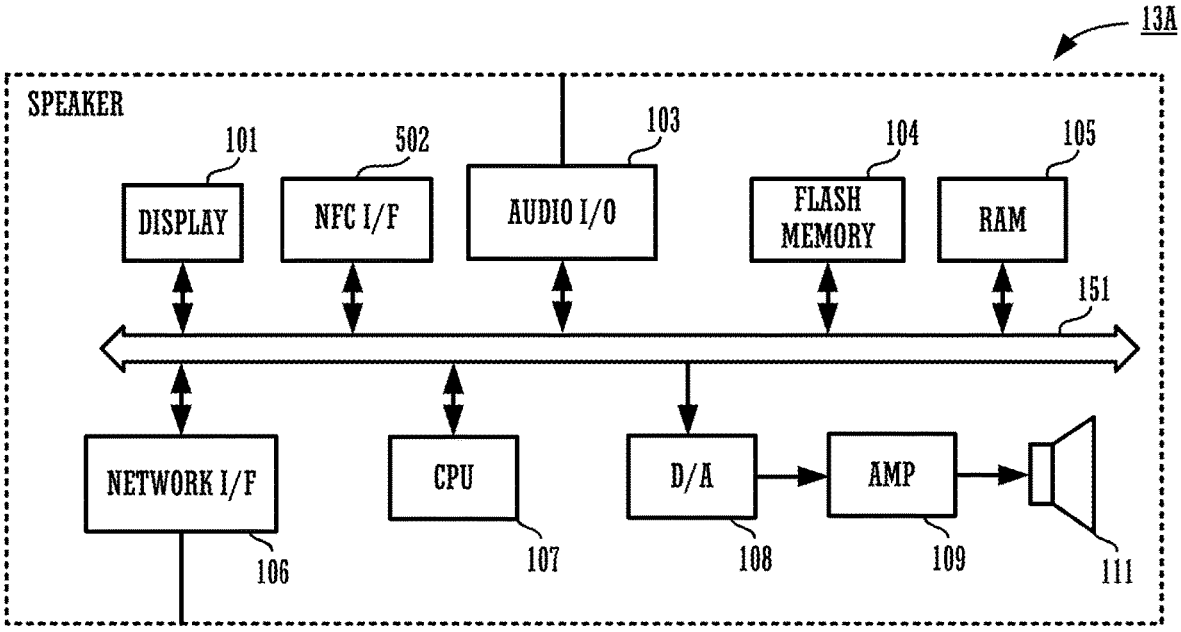
FIG. 10 is a block diagram showing a configuration of a speaker according to a fourth modification.

For example, the interface of the present subject matter is not limited to the user I/F 102. FIG. 10 is a block diagram showing a configuration of a speaker 13A according to a fourth modification. The speaker 13A according to the fourth modification includes an NFC (Near field communication) I/F 502 in place of the user I/F 102.

Figure 11:
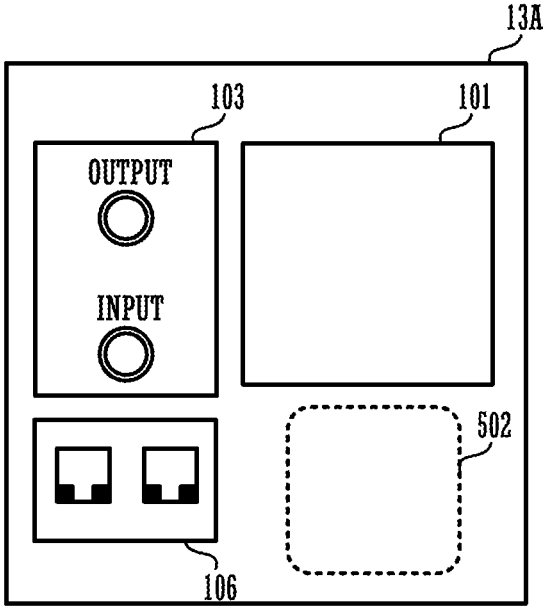
FIG. 11 is a view showing an example of an external appearance of a display 101, an audio I/O 103, and a network I/F 106, and an NFC I/F 502 of a speaker 13A according to the fourth modification.

The NFC I/F 502, as shown in FIG. 11, is provided in a portion of a housing of the speaker 13A, for example. In the example of FIG. 11, the NFC I/F 502 is provided near the display 101. The NFC I/F 502 is an example of a communication interface and performs communication with other devices through an antenna. According to the NFC standards, a communicable distance is limited to a close range such as 10 cm, for example. Therefore, the NFC I/F 502 is able to communicate with only a device within a close range. As a matter of course, the communication interface used for the present subject matter is not limited to the NFC.

Figure 12:
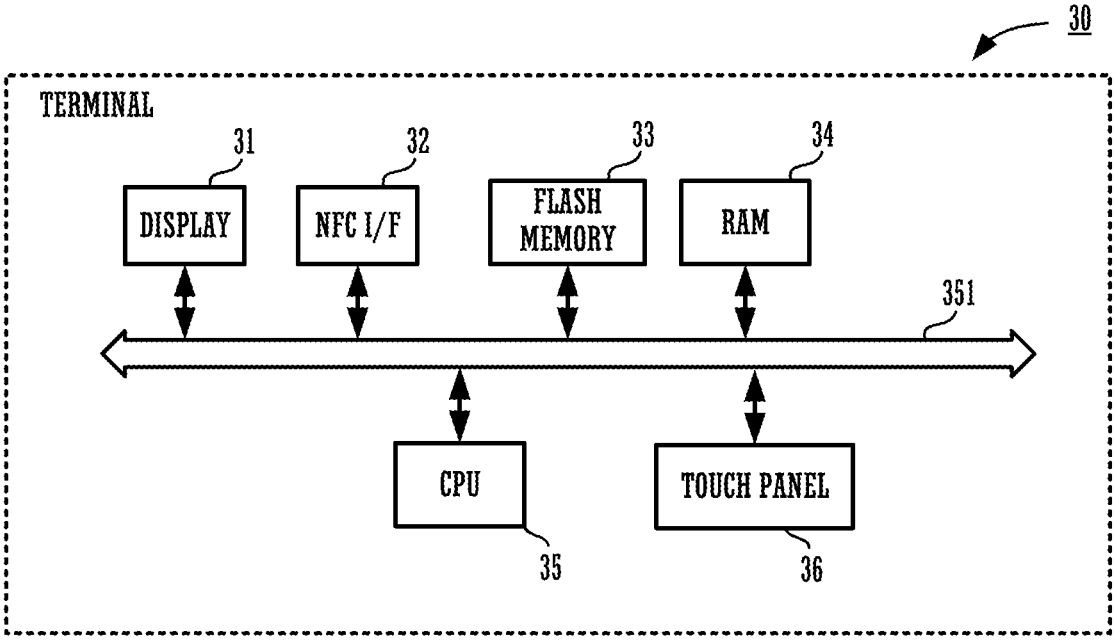
FIG. 12 is a block diagram showing a configuration of a user terminal 30 according to the fourth modification.

FIG. 12 is a block diagram showing a configuration example of a terminal 30 that a user uses. The terminal 30 may be an information processor such as a personal computer, a smartphone, or a tablet PC, for example. The terminal 30 includes a display 31, an NFC I/F 32, a flash memory 33, a RAM 34, a CPU 35, and a touch panel 36 that are connected to each other through a bus 351.

Figure 13:
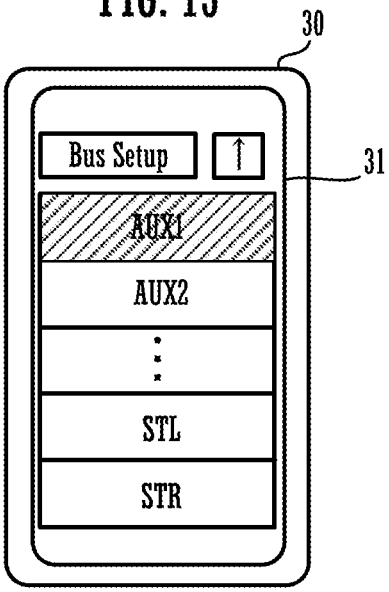
FIG. 13 is an external view of the user terminal 30 according to the fourth modification.

FIG. 13 shows an example of a screen displayed on the display 31. It is to be noted that the touch panel 36 is stacked on the display 31, which configures a GUI. The display 31 displays a bus setup screen as shown in FIG. 13. The AUX1, the AUX2 . . . the AUXn, the STL, and the STR that are the buses of the mixer 11 are displayed on the bus setup screen. A user selects any bus to be assigned to the speaker 13A from the displayed buses. In the example of FIG. 13, the user has selected the AUX1 bus. An application program for displaying such a screen and receiving a selection of a bus is stored in the flash memory 33. The CPU 35 reads the application program stored in the flash memory 33 being a storage medium to the RAM 34 and implements the above-described function.

It is to be noted that the program that the CPU 35 reads does not also need to be stored in the flash memory 33 in the own device. For example, the program may be stored in a storage medium of an external device such as a server. In such a case, the CPU 35 may read the program each time from the server to the RAM 34 and may execute the program.

Figure 14:
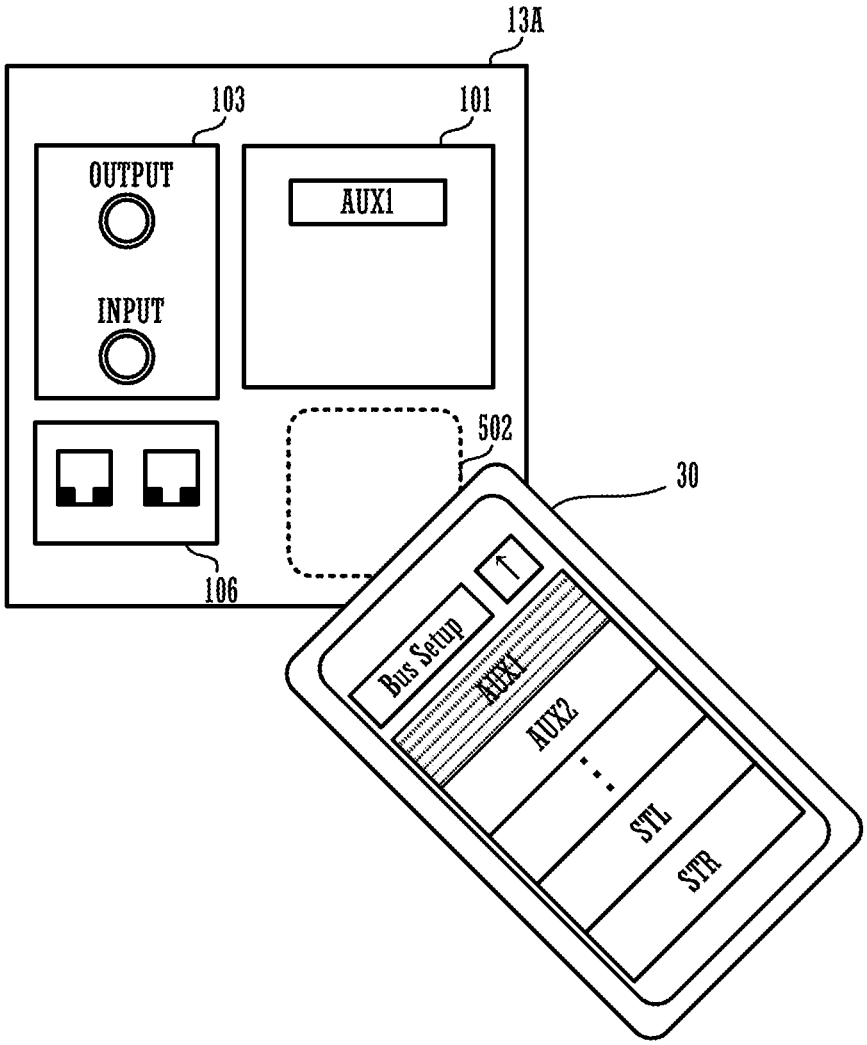
FIG. 14 is a view showing a relationship between the user terminal 30 and the NFC I/F 502 according to the fourth modification.

A user, as shown in FIG. 14, brings the terminal 30 closer to the NFC I/F 502 of the speaker 13A. The terminal includes an NFC I/F 32. The CPU 35 sends information corresponding to the bus that the user has selected, through the NFC I/F 32. The information corresponding to a bus, for example, as described above, is a unique ID assigned to each bus.

The CPU 107 of the speaker 13A receives an ID through the NFC I/F 502. The CPU 107 stores the ID in the flash memory 104 or the RAM 105. Subsequently, the CPU 107, in a case of receiving an inquiry from the mixer 11, for example, as another device on a network, reads the ID from the flash memory 104 or the RAM 105, and sends the ID to the mixer 11 being a management device.

In this manner, even by use of the NFC I/F, assignment of a bus is also able to be instructed to a management device. The communicable distance of the NFC I/F is limited to a close range such as 10 cm, for example. Therefore, a user, simply by operating a terminal such as a smartphone and performing an operation of bringing the terminal 30 closer to a desired speaker, can cause a sound of a desired bus to be outputted from the desired speaker.

It is to be noted that, in the example of FIG. 14, the CPU 107 displays a name (AUX1 in this example) of the bus according to the ID received through the NFC I/F 502, on the display 101. However, it is not essential in the present subject matter to display the name of a bus on the display 101. In addition, it is not essential in the present subject matter that the speaker 13A includes the display 101.

What is claimed is:

1. An audio system comprising:

an audio signal input and output device comprising:

a port to input an audio signal or to output an audio signal;

an interface to receive a specification of a channel among a plurality of channels to be assigned to the port, or to receive a specification of a bus among a plurality of buses to be assigned to the port; and a sender to send information assigning the channel to be assigned or the bus to be assigned to a management device based on the received specification, wherein the port inputs or outputs the audio signal on the channel assigned by the management device based on the information, or on the bus assigned by the management device based on the information; and the management device comprises:

a receiver to receive the information from the audio signal input and output device; and a processor to assign the port to the channel or the bus that corresponds to the port based on the received information.

2. The audio system according to claim 1, wherein
the information assigns the audio signal inputted from the port to a predetermined input channel of the management device.

3. The audio system according to claim 1, wherein
the information is sent to the management device through a network.

4. The audio system according to claim 1, wherein
the information includes an IP address of the audio signal input and output device to input or output the audio signal; and
the management device stores the IP address corresponding to the input channel or the output bus.

5. The audio system according to claim 1, wherein
the information includes an IP address of the audio signal input and output device to input or output the audio signal; and
the management device stores the IP address corresponding to the channel or the bus.

6. The audio system according to claim 1, wherein
the information includes an IP address of the audio signal input and output device to input or output the audio signal; and
the management device stores the IP address corresponding to the channel or the bus.

7. The audio system according to claim 1, wherein the processor is further configured to:
receive an inquiry from the management device, and
send the information in response to the inquiry received from the management device.

8. The audio system according to claim 1, wherein
the port is a first port; and
the audio signal input and output device further comprises:
a second port to input an audio signal or to output an audio signal, wherein
the input channel or output bus assigned to the first port is different from an input channel or output bus assigned to the second port.

9. The audio system according to claim 1, wherein the port is configured to:
receive an input audio signal; and
send the input audio signal to the management device.

10. The audio system according to claim 1, further comprising:
a speaker to emit a sound based on the inputted audio signal.

11. The audio system according to claim 10, wherein
the information assigns the inputted audio signal to a predetermined input channel of the management device.

12. The audio system according to claim 1, wherein the information is sent through a network.

* * * * *